US007981276B2

(12) United States Patent
Siskin et al.

(10) Patent No.: US 7,981,276 B2
(45) Date of Patent: Jul. 19, 2011

(54) DESULFURIZATION OF PETROLEUM STREAMS UTILIZING A MULTI-RING AROMATIC ALKALI METAL COMPLEX

(75) Inventors: Michael Siskin, Westfield, NJ (US); Ronald D Myers, Calgary (CA); Roby Bearden, Jr., Baton Rouge, LA (US); Thomas B. Rauchfuss, Urbana, IL (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 321 days.

(21) Appl. No.: 11/998,790

(22) Filed: Nov. 30, 2007

(65) Prior Publication Data

US 2009/0139903 A1 Jun. 4, 2009

(51) Int. Cl.

| | |
|---|---|
| ***C10G 45/04*** | (2006.01) |
| ***C10G 45/30*** | (2006.01) |
| ***C10G 19/00*** | (2006.01) |

(52) U.S. Cl. ..... 208/230; 208/209; 208/226; 208/237; 208/238

(58) Field of Classification Search ..... 208/226, 208/230, 238, 208 M, 209, 237
See application file for complete search history.

(56) References Cited

U.S. PATENT DOCUMENTS

| | | | | |
|---|---|---|---|---|
| 3,755,149 | A | 8/1973 | Kohn | |
| 3,952,052 | A | 4/1976 | Sherk | |
| 4,062,762 | A * | 12/1977 | Howard et al. | 208/211 |
| 4,127,470 | A | 11/1978 | Baird, Jr. et al. | |
| 6,123,835 | A | 9/2000 | Ackerson et al. | |
| 6,210,564 | B1 * | 4/2001 | Brons et al. | 208/208 M |
| 7,588,680 | B1 * | 9/2009 | Schucker | 208/208 M |
| 2006/0065577 | A1 | 3/2006 | Dysard et al. | |
| 2007/0151901 | A1 | 7/2007 | Sain et al. | |

OTHER PUBLICATIONS

Yu, Zhengkun and John G. Verkade. Desulfurization of Organosulfur Compounds with Lithium and Sodium. Energy & Fuels. 1999, 13, 23-28.*

Kazuya Ohga; Yoshiaki Kurauchi; Osamu Tsuji; Kazunori Tanezaki; Junko Nogami; Shigeru Morita; Desulfurization with metallic sodium. III. Decomposition of organic sulfur compounds by metallic sodium. Acceleration effect of tetralin and inhibition effect of aromatic hydrocarbons on the decomposition of thiophene; Nippon Kaguku Kaishi (1983), (7), 1064-9. Abstract.

F. Mensch; "Desulfurization of phenanthrene," Erdoel & Kohle, Erdgas, Petrochemic (1976), 29(4), 167. Abstract.

A. M. Aitani; M. F. Ali; H. H. Al-Ali; "A Review of non-conventional methods for the desulfurization of residual fuel oil," Petroleum Science adn Technology (2000), 18(5 & 6), 537-553. Abstract.

Eri Ito, J. A. Rob Van Veen,: On novel processes for removing sulphur from refinery streams, Catalysis Today (2006), 116(4), 446-460. Abstract.

* cited by examiner

*Primary Examiner* — Walter D Griffin
*Assistant Examiner* — Renee Robinson
(74) *Attorney, Agent, or Firm* — Bruce M. Bordelon

(57) ABSTRACT

The present invention relates to a process for removing sulfur from sulfur-containing hydrocarbon streams utilizing a multi-ring aromatic hydrocarbon complex containing an alkali metal ion. Preferably, the sulfur-containing hydrocarbon stream is comprised of high molecular weight hydrocarbons, such as a low API gravity, high viscosity crude, tar sands bitumen, an oil derived from shale, or heavy refinery intermediate stocks such as atmospheric resids or vacuum resids which are typically difficult to desulfurize and contain relatively high amounts of sulfur. However, intermediate refinery streams and refinery product streams may also be treated by the process of the current invention to achieve very low sulfur concentrations to meet environmental specification for fuels sulfur content.

26 Claims, 1 Drawing Sheet

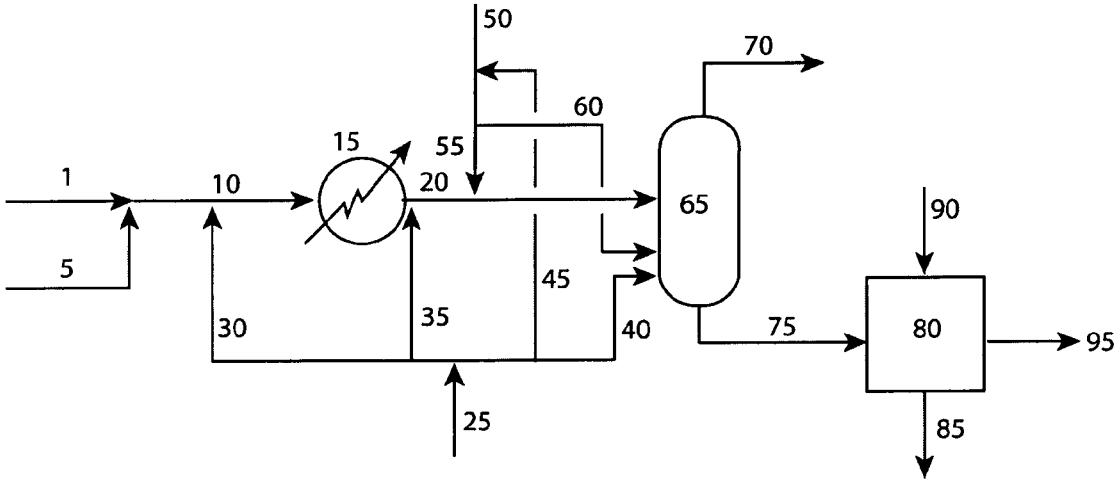
FIGURE

DESULFURIZATION OF PETROLEUM STREAMS UTILIZING A MULTI-RING AROMATIC ALKALI METAL COMPLEX

FIELD OF THE INVENTION

The present invention relates to a process for removing sulfur from sulfur-containing hydrocarbon streams utilizing a multi-ring aromatic hydrocarbon complex containing an alkali metal ion. Preferably, the sulfur-containing hydrocarbon stream is comprised of high molecular weight hydrocarbons, such as a low API gravity, high viscosity crude, tar sands bitumen, oils derived from shale, or heavy refinery intermediate stocks such as atmospheric resids or vacuum resids which are typically difficult to desulfurize and contain relatively high amounts of sulfur. However, intermediate refinery streams and refinery product streams (e.g., naphtha from catalytic cracking) may also be treated by the process of the current invention to achieve very low sulfur concentrations to meet environmental specification for fuels sulfur content.

DESCRIPTION OF RELATED ART

As the demand for hydrocarbon-based fuels has increased, the need for improved processes for desulfurizing hydrocarbon feedstocks of heavier molecular weight has increased as well as the need for increasing the conversion of the heavy portions of these feedstocks into more valuable, lighter fuel products. These heavier, "challenged" feedstocks include, but are not limited to, low API gravity, high viscosity crudes from such areas of the world as Canada, the Middle East, Mexico, Venezuela, and Russia, as well as less conventional refinery and petrochemical feedstocks derived from such sources as tar sands bitumen and shale oil. These heavier crudes and derived crude feedstocks contain a significant amount of heavy, high molecular weight hydrocarbons. A considerable fraction of these heavy oil streams are often in the form of large multi-ring hydrocarbon molecules and/or a conglomerated association of large molecules containing a large portion of the sulfur, nitrogen and metals in the hydrocarbon stream. A significant portion of the sulfur contained in these heavy oils is in the form of heteroatoms, including dibenzothiophenes, from which the sulfur is difficult to remove.

The high molecular weight, large multi-ring hydrocarbonaceous molecules or associated multi-ring hydrocarbon and aromatic heterocyclic molecules in the heavy oils are generally termed as asphaltenes. A significant portion of the sulfur is contained within the structure of these asphaltenes. Due to the large aromatic structures of the asphaltenes, this sulfur can be refractory in nature and is not very susceptible to removal by conventional alkali salt solution complexes such as potassium hydroxide or sodium hydroxide. Other intermediate refinery crude fractions, such as atmospheric resids, vacuum resids, and other, similar intermediate feedstreams containing boiling point materials above about 850° F. (454° C.) also contain similar sulfur polycyclic heteroatom complexes and are also difficult to desulfurize by conventional methods. These heavy crudes, derived refinery feedstocks, and heavy residual intermediate hydrocarbon streams can contain significant amounts of sulfur. Sulfur contents of in excess of 3 to 5 wt % are not uncommon for these streams and can often be concentrated to higher contents in the refinery heavy residual streams.

These high sulfur content hydrocarbon streams can be excessively corrosive to equipment in refinery and petrochemical production and/or exceed environmental limitations for use in associated processes. If a significant amount of the sulfur is not removed from these feedstocks prior to refining, significant costs in capital equipment may be required to process these crudes and the sulfur is generally still required to be removed by subsequent processes in order to meet intermediate and final product sulfur specifications. Additionally, many conventional catalytic refining and petrochemical processes cannot be used on these heavy feedstocks and intermediates due to their use of fixed bed catalyst systems and the tendency of these heavy hydrocarbons to produce excessive coking and deactivation of the catalyst systems when in contact of such feedstreams. Also, due to the excessive hydrocarbon unsaturation and cracking of carbon-to-carbon bonds experienced in these processes, significant amounts of hydrogen are required to treat asphaltene containing feeds. The high consumption of hydrogen, which is a costly feed material, in these processes results in significant costs associated with the conventional catalytic hydrotreating of heavy oils for sulfur removal.

Due to their high sulfur content, low API gravity, and high viscosity, and the difficulties in removing the sulfur at the wellheads or mines, these heavy hydrocarbon feedstreams cannot be readily transported over existing pipeline systems and they can be either severely discounted for use in producing higher value products. Another alternative utilized is to make these heavy oils suitable for pipeline transportation or petrochemical feed only after significant dilution with expensive, lower sulfur hydrocarbon diluents.

There is also a similar need for a desulfurization technology that is effective at low hydrogen pressure and one that does not saturate (i.e., hydrogenate) aromatic hydrocarbons or olefins. This is particularly true for the desulfurization of naphtha from catalytic cracking wherein retention of high octane components (e.g., aromatics and olefins) is desirable. This is also true for the conversion of highly-aromatic catalytic cycle oils into ultra-low sulfur fuel oils.

Therefore, there exists in the industry a need for an improved process for removing sulfur from heavy crudes, derived crudes, refinery residual streams and refinery product streams without requiring the use of structured catalysts or significant hydrogen consumption.

SUMMARY OF THE INVENTION

One embodiment of the present invention is a process for removing sulfur from a sulfur-containing hydrocarbon feedstream, comprising:

a) contacting an alkali metal with a multi-ring aromatic-containing stream to form a multi-ring aromatic alkali metal complex;

b) contacting a sulfur-containing hydrocarbon feedstream with the multi-ring aromatic alkali metal complex at a reaction temperature of about 32° F. to about 650° F. (0 to 343° C.) to form a mixed reaction stream; and c) separating a low-sulfur product stream and a high-sulfur reaction products stream comprising alkali-metal/sulfur compounds from the mixed reaction stream;

wherein the low-sulfur product stream has a lower sulfur wt % content than the sulfur-containing hydrocarbon feedstream.

In a preferred embodiment, the alkali metal is selected from lithium, sodium, potassium, rubidium and cesium.

In yet another embodiment, the sulfur-containing hydrocarbon feedstream above is also contacted with the multi-ring aromatic alkali metal complex in the presence of a hydrogen-containing gas wherein the hydrogen partial pressure is from about 25 to about 500 psi (172 to 3,447 kilopascals) hydrogen partial pressure.

In an embodiment of the present invention, sulfur-containing hydrocarbon feedstream is comprised of a heavy hydrocarbon stream selected from crude oil, tar sands bitumen, oils derived from shale, atmospheric resid and vacuum resid. In further preferred embodiments, the product produced by the present invention has a lower sulfur wt % content, a lower kinematic viscosity, and higher API gravity than the sulfur-containing hydrocarbon feedstream.

In yet other preferred embodiments, the sulfur-containing hydrocarbon feedstream is comprised of a naphtha, a distillate, a gasoline or a diesel producing an ultra-low sulfur product stream. It is even more preferred in this embodiment if the sulfur content of the produced product is below 50 ppmw or even 10 ppmw sulfur.

BRIEF DESCRIPTION OF THE FIGURES

The FIGURE illustrates one embodiment of a process scheme utilizing a multi-ringed aromatic alkali metal complex to desulfurize a sulfur-containing hydrocarbon stream.

DETAILED DESCRIPTION OF THE INVENTION

The present invention is a method for reducing the sulfur content in hydrocarbon streams. In an embodiment, the hydrocarbon feedstream to be treated contains sulfur heteroatoms that are part of the high molecular weight, polycyclic asphaltene compounds or they are associated with such associated asphaltene species. It should be noted here that the terms "hydrocarbon-containing stream", "hydrocarbon stream" or "hydrocarbon feedstream" as used herein are equivalent and are defined as any stream containing at least 75% wt % hydrocarbons. As discussed, conventional methods of treating the heavy hydrocarbons with such compounds as alkali metal salt solutions are often not highly efficient due to the inability to obtain a high solubility level between the alkali metal salt solution and the heavy hydrocarbon. Conventionally, additional equipment and/or energy are required to increase the solubility and/or interface contact between the alkali solution and the hydrocarbons containing the sulfur heteroatoms. Such methods include the use of equipment such as high shear mixers or by raising the temperature of the salt solution/hydrocarbon mixture. However, these methods often have limited success and additionally require the use of additional capital and energy costs associated with the required pumps, mixers, heaters, etc to achieve the interface contact necessary to achieve acceptable sulfur removal rates.

It has been discovered that radical anion complexes of alkali metals with multi-ring aromatics are highly effective reagents for removing sulfur from hydrocarbon streams, particularly when applied in the presence of hydrogen. The activity of such complexes appears to be driven in part from their solubility (or miscibility) with the hydrocarbon feedstream. Typical alkali metal radical anion reagents that can be employed in the process of this invention include the following: lithium naphthalide, potassium naphthalide, sodium naphthalide, lithium anthracide, potassium anthracide and sodium anthracide. A more complete listing can be found in *Radical Anions*, E. T. Kaisen and L. Kevans, eds., Interscience Publishers (1968), which is incorporated herein by reference. Also see N. D. Scott, J. F. Walker and V. L. Hansley, *J. of the Amer. Chem. Soc.,* 58, 2442 (1936), which is incorporated herein by reference.

In preferred embodiments, the alkali metal is selected from lithium, sodium, potassium, rubidium and cesium. In a more preferred embodiment, the alkali metal is selected from sodium and potassium, and most preferably the alkali metal utilized is sodium.

An example of the formulation of one such multi-ringed aromatic alkali metal complex is shown below for sodium naphthalene:

[1]

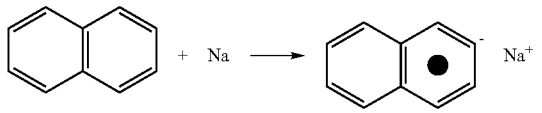

As can be seen, the sodium donates one electron to the naphthalene to form a complex comprised of a naphthalene anion radical and a sodium cation. The benefit of this complex is that it is manner in forming a complex from elemental alkali metals which is highly soluble in the hydrocarbon feedstream and is also highly soluble in the multi-ring aromatic asphaltenes portion of the stream which contains a significant portion of the highly refractory sulfur heteroatoms in heavy oil streams. This highly soluble multi-ringed aromatic alkali metal complex is very effective in removing sulfur from the asphaltene compounds in the hydrocarbon stream as well as less refractory sulfur compounds contained in the stream. Depending upon the molar ratio of the alkali metal cations to sulfur content of the feed as well as the operating parameters of the process selected, high sulfur removal can be achieved. In a preferred embodiment, sulfur removal of at least 50 wt % is achieved.

It should be noted that in some instances only a small amount of sulfur reduction, often less than 50 wt % removal, may be desirable in order to only obtain the amount of sulfur reduction required for a certain application such as, but not limited to, a petroleum refining crude maximum sulfur specification. However, in preferred embodiment, the present process can achieve sulfur removals of at least 75 wt %, or even at least 90 wt %. Generally however, these high levels of sulfur removal will not be required for treating the heavy hydrocarbons noted above.

An additional benefit of the current invention is that when the process is utilized in conjunction with the upgrade of heavy crudes or crudes derived from tar sands bitumens or shale oil, the targeted removal of the sulfur by the process, especially in the asphaltenes portion of the heavy oil, tends to break down the asphaltenes into smaller multi-ring aromatics and asphaltene complexes. This can result in significant reduction of the viscosity of the desulfurized hydrocarbon stream produced by the process. This is an especially beneficial result when the desulfurized product from the present process is further utilized in pipeline and/or storage applications. Here, significantly lower costs for pipeline applications can be realized due to lower energy costs necessary to pump the product through a pipeline or for heated storage to maintain the product viscosity at manageable levels. This viscosity reduction can also be utilized to increase pipeline capacity due to increasing the flowrates achievable under pipeline pressure limitations. It should be noted that the viscosity reduction between two streams should be compared at a standard temperature, for example, 100° C. (212° F.).

In an embodiment, the current invention may also be utilized in a process to achieve selective deep desulfurization rates from lighter hydrocarbon streams. The current invention may be used to desulfurize hydrocarbon naphtha and/or distillate streams to extremely low sulfur concentrations to meet low sulfur diesel and gasoline specifications. Naphthas are typical refinery and petrochemical hydrocarbon streams boiling in the range of about 80° F. to about 450° F. (27 to 232° C.). Distillates are typical refinery and petrochemical hydrocarbon streams boiling in the range of about 350° F. to about 650° F. (177 to 343° C.). In another embodiment, the present invention can be utilized to desulfurize gasoline and diesel final boiling range specification products.

In an embodiment of the present invention, the multi-ringed aromatic alkali metal complex herein is utilized in a process to desulfurize a naphtha or distillate range hydrocarbon stream to achieve a resulting product stream containing less than about 50 ppmw (parts per million by weight) of sulfur, and more preferably a product stream containing less than about 25 ppmw of sulfur. However, if ultra-deep desulfurization is required, the process of the present invention can be utilized to desulfurize a naphtha or distillate range hydrocarbon stream to achieve a resulting product stream containing less than about 10 ppmw of sulfur or even a product stream containing less than about 5 ppmw of sulfur. When high desulfurization of a hydrocarbon stream is desired, it is preferred if the alkali metal in the reagent to feed sulfur molar ratio is about 1.8 to 2.4 mole ratio. More preferably, the sodium reagent to feed sulfur molar ratio is adjusted to about 2.0 to 2.2 mole ratio. For ultra-deep desulfurization, the alkali metal in the reagent to feed sulfur molar ratio may be increased to about 2.0 to about 2.5 mole ratio.

Another benefit of the present invention is that in the high desulfurization and/or ultra-deep desulfurization of naphtha and/or distillate streams, less molecular weight reduction and saturation of olefins can be achieved as compared to conventional catalytic hydrotreating methods for sulfur removal. This has the benefits of lower hydrogen consumption in the desulfurization of these fuels, as well as lower product yield loss, and higher octane retention.

As can be seen in the description above for the formulation of the sodium naphthalene radical complex, the complex forms a naphthalene anion radical and a sodium cation. Due to the high solubility of the complex in hydrocarbons, the sodium cation is highly reactive with the sulfur in the hydrocarbon feedstream forming sodium/sulfur compounds such as sodium sulfide ($Na_2S$) which can be removed from the hydrocarbon feedstream and regenerated by conventional techniques. It is desired that the remaining multi-ring aromatic anion radicals not polymerize with other multi-ring aromatic anion radicals or with the asphaltene molecules. In a preferred embodiment, the multi-ringed aromatic alkali metal complex is contacted with the hydrocarbon feedstream in the presence of a hydrogen gas. Herein, a "hydrogen gas" or "hydrogen-containing gas" is defined as any gas containing at least 70 mol % hydrogen. In an embodiment, the hydrocarbon feedstream and multi-ringed aromatic alkali metal complex mixture is contacted in the presence of a gas with about 25 to about 500 psi (172 to 3,447 kilopascals) partial pressure hydrogen. In a more preferred embodiment, the hydrocarbon feedstream and multi-ringed aromatic alkali metal complex mixture is contacted in the presence of a gas with about 50 to about 200 psi (345 to 1,379 kilopascals) partial pressure hydrogen.

In preferred embodiments, the hydrocarbon feedstream, the multi-ringed aromatic alkali metal complex, and the hydrogen gas is combined at or heated to a reaction temperature from about 32° F. to about 650° F. (0 to 343° C.). More preferably, the reaction temperature is from about 375° F. to about 650° F. (191 to 343° C.). The mixture is preferably maintained under these conditions for a reaction time of about 2 minutes to about 2 hours. However, depending on the average molecular weight of the hydrocarbons, the sulfur content and the amount of sulfur to be removed, reaction times may be from about 2 minutes to about 30 minutes or preferably even about 2 minutes to about 15 minutes.

The aromatic/alkali metal complex herein can be formed from any aromatic-containing hydrocarbon stream which contains polycyclic aromatic compounds. It has been found that alkali metal complexes formed from single-ringed aromatic compounds are not as effective in removing sulfur as those complexes formed from hydrocarbon compounds containing two or more aromatic rings.

Therefore, it is preferred if the hydrocarbon stream utilized in forming the aromatic/alkali metal complex reagent contain a significant concentration of polycyclic aromatic compounds. In many crude upgrading and petroleum refining processes such high aromatic content streams may be available for using in forming aromatic/alkali metal complex. Such streams include, but are not limited to, light catalytic cycle oils ("LCCOs") which contain high concentrations of alkynaphthlenes and catalytic slurry oils ("CSOs") which contain high concentrations of unsubstituted and methyl substituted two to six ring aromatics. Although not required for the present invention, it is preferred if the aromatic-containing hydrocarbon streams contain at least about 20 wt % multi-ring aromatic compounds. More preferably, the aromatic-containing hydrocarbon streams utilized in the present invention contain at least about 25 wt % multi-ring aromatic compounds, and even more preferably, at least about 30 wt % multi-ring aromatic compounds.

Alternatively, relatively pure streams of multi-ring aromatics may be used to form the aromatic/alkali metal complex reagent. It is preferred if the aromatic/alkali metal complex reagent be formed from an elemental form of the alkali metals. The elemental form of these alkali metals will react when contacted with the multi-ring aromatic containing stream to form the multi-ringed aromatic alkali metal complexes utilized in the present invention.

One embodiment of the present invention is shown in the attached FIGURE. This FIGURE is meant to provide a simplified illustration of one embodiment of a process scheme for utilizing multi-ringed aromatic alkali metal complexes disclosed herein for sulfur removal from a hydrocarbon stream and is not meant to limit the present invention. In the FIGURE, an elemental alkali metal (1) is mixed with a multi-ring aromatic-containing stream (5). It is preferred that the alkali metal be molten. The mixed complex stream (10) containing the multi-ringed aromatic alkali metal complex reagent can be optionally heated by a feed heat exchanger (15) to at or near the desired reaction temperature if needed to form a heated mixed complex stream (20). Optionally, the elemental alkali metal stream (1), the multi-ring aromatic-containing stream (5), and/or the sulfur-containing hydrocarbon stream (50) can be preheated as necessary to provide the heat required to achieve the desired reaction temperature.

The rate of formation of the multi-ringed aromatic alkali metal complex reagent is dependent on the temperature of the alkali metal/multi-ring aromatic mixed complex stream (or simply "mixed complex stream") and may also be dependent upon the composition of the mixed complex stream. In order to maintain a commercially appreciable rate of formation, in a preferred embodiment, it is desired that the mixed complex stream (10) is at or heated to a temperature of from about 68° F. to about 662° F. (20 to 350° C.). In more preferred embodiments, the temperature of the mixed complex stream is at or heated to a temperature of from about 212° F. to about 662° F.

(100 to 350° C.), and even more preferably about 392° F. to about 662° F. (200 to 350° C.).

All or some of the hydrogen gas (25) can be mixed either upstream of the heater (15) via conduit (30), downstream of the heater (15) via conduit (35), directly into the reaction/separation vessel (65) via conduit (40), and/or into the sulfur-containing hydrocarbon stream (50) via conduit (45). Preferably the hydrogen gas is mixed upstream of the reaction/separation vessel (65) to improve mixing and allow for a longer reaction time. It is preferred that if the some or all of the hydrogen gas (25) is injected directly into the reaction/separation vessel (65) that a distributor be utilized to provide for proper distribution and improved contact with the sulfur-containing hydrocarbon stream and the multi-ringed aromatic alkali metal complex reagent.

All or some of the sulfur-containing hydrocarbon stream (50) can either be mixed upstream of the reaction/separation vessel (65) via conduit (55) or directly into the reaction/separation vessel (65) via conduit (60). Preferably the sulfur-containing hydrocarbon stream (50) is mixed upstream of the reaction/separation vessel (65) to improve mixing and allow for a longer reaction time. From the reaction/separation vessel (65), an overhead gas (70) is drawn off which contains hydrogen. Hydrogen sulfide and/or hydrocarbons may also be present in the overhead gas. A reaction effluent stream (75) is drawn off from the reaction/separation vessel (65). The reaction effluent stream (75) in comprised of the desulfurized hydrocarbon as well as alkali metal/sulfur compounds from the desulfurization reaction. Most of the converted sulfur compounds in reaction effluent (75) will be in the form of low solubility alkali metal/sulfur compounds, such as $Na_2S$, which can then be removed form the reaction effluent stream in a separator (80). The separator can use filtering, gravity settling, or centrifuging technology or any technology available in the art to separate the alkali metal/sulfur compounds (85) to produce a low-sulfur product stream (95). A solvent (90) may be optionally utilized in this separation step to improve the separation of the low-sulfur product stream (95) from the alkali metal/sulfur compounds (85).

Although the present invention has been described in terms of specific embodiments, it is not so limited. Suitable alterations and modifications for operation under specific conditions will be apparent to those skilled in the art. It is therefore intended that the following claims be interpreted as covering all such alterations and modifications as fall within the true spirit and scope of the invention.

What is claimed is:

1. A process for removing sulfur from a sulfur-containing hydrocarbon feedstream, comprising:

a) contacting an alkali metal with a multi-ring aromatic-containing stream to form a multi-ring aromatic alkali metal complex comprising two or more aromatic rings;

b) contacting a sulfur-containing hydrocarbon feedstream with the multi-ring aromatic alkali metal complex at a reaction temperature of about 32° F. to about 650° F. (0 to 343° C.) to form a mixed reaction stream; and c) separating a low-sulfur product stream and a high-sulfur reaction products stream comprising alkali-metal/sulfur compounds from the mixed reaction stream;

wherein the low-sulfur product stream has a lower sulfur wt % content than the sulfur-containing hydrocarbon feedstream.

2. The process of claim 1, wherein the alkali metal is selected from lithium, sodium, potassium, rubidium and cesium.

3. The process of claim 2, wherein the sulfur-containing hydrocarbon feedstream is contacted with the multi-ring aromatic alkali metal complex in the presence of a hydrogen-containing gas wherein the hydrogen partial pressure is from about 25 to about 500 psi (172 to 3,447 kilopascals) hydrogen partial pressure.

4. The process of claim 3, wherein an overhead gas stream comprising hydrogen is also separated from the mixed reaction stream.

5. The process of claim 3, wherein the sulfur content of the low-sulfur product stream is at least about 50 wt % lower than the sulfur content of the sulfur-containing hydrocarbon feedstream.

6. The process of claim 5, wherein the reaction contact time for the sulfur-containing hydrocarbon feedstream and the multi-ring aromatic alkali metal complex is from about 2 minutes to about 2 hours.

7. The process of claim 6, wherein the alkali metal is selected from sodium and potassium.

8. The process of claim 3, wherein the sulfur-containing hydrocarbon feedstream has a sulfur content of at least 3 wt %.

9. The process of claim 8, wherein the sulfur-containing hydrocarbon feedstream is comprised of a heavy hydrocarbon stream selected from crude oil, tar sands bitumen, oils derived from shale, atmospheric resid and vacuum resid.

10. The process of claim 8, wherein the sulfur content of the low-sulfur product stream is at least about 50 wt % lower than the sulfur content of the sulfur-containing hydrocarbon feedstream.

11. The process of claim 10, wherein the alkali metal to feed sulfur molar ratio is about 1.8 to 2.4 mole ratio.

12. The process of claim 11, wherein the reaction temperature is from about 375° F. to about 650° F. (191 to 343° C.) and the reaction contact time for the sulfur-containing hydrocarbon feedstream and the multi-ring aromatic alkali metal complex is from about 2 minutes to about 2 hours.

13. The process of claim 12, wherein the multi-ring aromatic-containing stream contains at least about 20 wt % multi-ring aromatic compounds.

14. The process of claim 13, wherein the alkali metal is selected from sodium and potassium.

15. The process of claim 14, wherein the kinematic viscosity of the low-sulfur product stream at 100° C. (212° F.) is lower than the kinematic viscosity of the sulfur-containing hydrocarbon feedstream at 100° C. (212° F.).

16. The process of claim 15, wherein the sulfur content of the low-sulfur product stream is at least about 75 wt % lower than the sulfur content of the sulfur-containing hydrocarbon feedstream.

17. The process of claim 3, wherein the sulfur-containing hydrocarbon feedstream is comprised of a refinery hydrocarbon stream selected from a naphtha and a distillate.

18. The process of claim 3, wherein the sulfur-containing hydrocarbon feedstream is comprised of a refinery hydrocarbon stream selected from a gasoline product stream and a diesel product stream.

19. The process of claim 17, wherein the sulfur content of the low-sulfur product stream is at least about 50 wt % lower than the sulfur content of the sulfur-containing hydrocarbon feedstream.

20. The process of claim 19, wherein the sulfur content of the low-sulfur product stream is less than 50 ppmw.

21. The process of claim 20, wherein the alkali metal to feed sulfur molar ratio is about 2.0 to 2.5 mole ratio.

22. The process of claim 21, wherein the reaction contact time for the sulfur-containing hydrocarbon feedstream and the multi-ring aromatic alkali metal complex is from about 2 minutes to about 30 minutes.

23. The process of claim 22, wherein the multi-ring aromatic-containing stream contains at least about 20 wt % multi-ring aromatic compounds.

24. The process of claim 23, wherein the alkali metal is selected from sodium and potassium.

25. The process of claim 24, wherein the sulfur content of the low-sulfur product stream is at least about 75 wt % lower than the sulfur content of the sulfur-containing hydrocarbon feedstream and the sulfur content of the low-sulfur product stream is less than 10 ppmw.

26. The process of claim 1, wherein the multi-ring aromatic alkali metal complex is selected from lithium naphthalide, potassium naphthalide, sodium naphthalide, lithium anthracide, potassium anthracide and sodium anthracide.

* * * * *